US007949285B2

(12) United States Patent
Yoon

(10) Patent No.: US 7,949,285 B2
(45) Date of Patent: May 24, 2011

(54) IMAGE FORMING APPARATUS AND POWER TRANSMISSION DEVICE THEREOF

(75) Inventor: Young Min Yoon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 579 days.

(21) Appl. No.: 12/030,278

(22) Filed: Feb. 13, 2008

(65) Prior Publication Data

US 2008/0226345 A1 Sep. 18, 2008

(30) Foreign Application Priority Data

Mar. 15, 2007 (KR) ..... 10-2007-0025608

(51) Int. Cl.
*G03G 15/00* (2006.01)

(52) U.S. Cl. ..... 399/167; 399/119; 399/223; 399/228; 192/21

(58) Field of Classification Search ..... 399/119, 399/167, 223, 228; 192/21
See application file for complete search history.

(56) References Cited

U.S. PATENT DOCUMENTS

2006/0239716 A1* 10/2006 Kim et al. ..... 399/228

FOREIGN PATENT DOCUMENTS

CN 1854926 11/2006
KR 10-636217 7/2006

OTHER PUBLICATIONS

Chinese Office Action issued Nov. 13, 2009 in CN Application No. 2008100966952.

* cited by examiner

*Primary Examiner* — Ryan D Walsh
(74) *Attorney, Agent, or Firm* — Stanzione & Kim, LLP

(57) ABSTRACT

An image forming apparatus and a power transmission device capable of intermittently transmitting power reliably to a plurality of driven bodies from a driving source with a small number of clutches. The power transmission device includes a cam part which rotates by receiving power of the driving source, a clutch device which intermittently transmits the power to the cam part to determine a stop position of the cam part, a first power transmission unit which transmits the power to any one of the plurality of driven bodies according to the stop position of the cam part, and a second power transmission unit which transmits the power to the other driven bodies of the plurality of driven bodies according to the stop position of the cam part. The cam part includes a rotating disc and a plurality of press members which are provided on one surface of the rotating disc to press the first power transmission unit and the second power transmission unit according to the stop position of the rotating disc.

17 Claims, 9 Drawing Sheets

IMAGE FORMING APPARATUS AND POWER TRANSMISSION DEVICE THEREOF

CROSS-REFERENCE TO RELATED APPLICATIONS

This application claims the benefit under U.S.C. 119 (a) of Korean Patent Application No. 2007-0025608, filed on Mar. 15, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly to an image forming apparatus having a power transmission device that intermittently transmits power to a plurality of driven bodies from a driving source.

2. Description of the Related Art

An image forming apparatus is an apparatus that prints an image on a printing medium, e.g., paper, according to an input image signal. One type of image forming apparatus is an electrophotographic color image forming apparatus, which is configured such that a beam is scanned across a photosensitive body. The photosensitive body is charged with a predetermined electric potential to form an electrostatic latent image on the outer peripheral surface of the photosensitive body, the electrostatic latent image is then developed into a visible image by supplying toners to the electrostatic latent image, and the visible image is transferred onto and fixed to paper. Typically, toners of four colors of yellow (Y), magenta (M), cyan (C), and black (K) are used in the color image forming apparatus, and thus four developing devices corresponding to the respective colors are required.

Various rotating bodies, including photosensitive bodies and developing rollers, are mounted to the developing devices, and the rotating bodies are driven by one or more driving sources provided in the image forming apparatus.

In order to save on the cost of components, generally the number of motors used is as small as possible. Thus, in many cases, a plurality of developing devices are driven by one motor. The single motor either drives only one of the developing devices, drives all the developing devices at the same time, or drives all the developing devices in sequence. To achieve this, a power transmission device is mounted on a path through which the power from the motor is transmitted to the developing devices. In some circumstances, the power transmission device transmits power to only the developing devices that are to be driven, and interrupts power to the developing devices that do not need to be driven.

An example of a conventional image forming apparatus having the above power transmission device is disclosed in Korean Patent Registration No. 636217, which includes two electronic clutches and one solenoid to intermittently transmit power to a plurality of developing devices.

However, the disclosed conventional power transmission device is uneconomical because it requires at least two electronic clutches which are expensive, and is limited in that it cannot be utilized in a compact image forming apparatus because the size of the electronic clutch is increased as a result of an increase in the driving loads of the developing devices.

Further, electric current is continuously applied to the electronic clutch to transmit power. Accordingly, when successively transmitting power over a long period of time, heat is generated from the electronic clutch, causing deterioration in the performance of the electronic clutch, and consequently the electronic clutch malfunctions.

SUMMARY OF THE INVENTION

The present general inventive concept provides an image forming apparatus and a power transmission device thereof that is capable of reliably transmitting intermittent power to a plurality of driven bodies from a driving source with a small number of clutches.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus including a driving source, a plurality of driven bodies which are driven by the driving source, and a power transmission device which is provided between the driving source and the plurality of driven bodies. The power transmission device includes a cam part which rotates by receiving power from the driving source, a clutch device which intermittently transmits power to the cam part to determine a stop position of the cam part, a first power transmission unit which transmits the power to any one of the plurality of driven bodies according to the stop position of the cam part, and a second power transmission unit which transmits the power to the other driven bodies of the plurality of driven bodies according to the stop position of the cam part.

The cam part may include a rotating disc and a plurality of press members which are provided on one surface of the rotating disc to press the first power transmission unit and the second power transmission unit according to the stop position of the rotating disc.

The plurality of press members may press only the first power transmission unit or may press both the first power transmission unit and the second power transmission unit according to the stop position of the cam part.

The plurality of press members may also be separated from the first power transmission unit and the second power transmission unit according to the stop position of the cam part so that the first power transmission unit and the second power transmission unit are in an unpressed state.

The plurality of press members may also include three press protrusions which are arranged along a circumference of the rotating disc.

Two of the three press protrusions may be spaced apart from each other by 90 degrees along the circumference of the rotating disc, and another two of the three press protrusions may be spaced apart from each other by 135 degrees along the circumferential direction of the rotating disc.

The clutch device may include a plurality of position determining parts to determine the stop position of the cam part, and a restriction unit which restricts the plurality of position determining parts in ON/OFF states.

The plurality of position determining parts may include a first position determining part which interferes with the restriction unit when the restriction unit is in the ON state to determine a home position of the cam part; and a second position determining part, a third position determining part and a fourth position determining part which interfere with the restriction unit when the restriction unit is in the OFF state.

When the restriction unit restricts the first position determining part or the second position determining part, the cam part is separated from the first power transmission unit and the second power transmission unit to interrupt the power transmission to the plurality of driven bodies.

When the restriction unit restricts the third position determining part, the cam part interferes with the first power transmission unit to transmit the power through the first power transmission unit.

When the restriction unit restricts the fourth position determining part, the cam part interferes with both the first power transmission unit and the second power transmission unit to transmit the power through the first power transmission unit and the second power transmission unit.

Each of the first power transmission unit and the second power transmission unit may include a driving gear, a coupling gear which slides by interacting with the cam part and rotates by receiving power from the driving source, and an elastic member which elastically biases the coupling gear to a direction of separating the coupling gear from the driving gear.

The plurality of driven bodies may include four developing devices with respective colors including yellow, magenta, cyan and black, and the first power transmission unit may transmit power to the developing device for black of the four developing devices.

The foregoing and/or other aspects and utilities of the present general inventive concept may also be achieved by providing a power transmission device of an image forming apparatus, which intermittently transmits power from a driving source to a plurality of developing devices for respective colors, including a rotating disc which rotates by receiving the power of the driving source a plurality of press members which are provided on one surface of the rotating disc, a clutch device which intermittently transmits the power from the driving source to the rotating disc to determine a stop position of the rotating disc, a first coupling gear which interferes with any one of the plurality of press members according to the stop position of the rotating disc to transmit the power to any one of the plurality of developing devices, and a second coupling gear which interferes with the other one of the plurality of press members according to the stop position of the rotating disc to transmit the power to the other developing devices of the plurality of developing devices.

The plurality of press members may include three press protrusions which are arranged along a circumference of the rotating disc.

When the rotating disc is located at a first position or a second position, the three press protrusions are separated from the first coupling gear and the second coupling gear.

When the rotating disc is located at a third position, any one of the three press protrusions press the first coupling gear.

When the rotating disc is located at a fourth position, another one of the three press protrusions presses the first coupling gear, and yet another one of the three press protrusions presses the second coupling gear.

The first position may be a home position of the rotating disc, the second position may be separated by a 90 degree angle from the first position, the third position may be separated by a 180 degree angle from the first position, and the fourth position may be separated by a 270 degree angle from the first position.

The clutch device may include a spring clutch which has a plurality of position determining parts to determine the stop position of the rotating disc, and a restriction unit which restricts the plurality of position determining parts in ON/OFF states.

The plurality of position determining parts may include a first position determining part which interferes with the restriction unit when the restriction unit is in the ON state to determine a home position of the rotating disc, and a second position determining part, a third position determining part and a fourth position determining part which interfere with the restriction unit when the restriction unit is in the OFF state.

The foregoing and/or other aspects and utilities of the present general inventive concept may also be achieved by providing an image forming apparatus that transmits power from a driving source to a plurality of developing devices with respective colors including a disc to selectively rotate to a plurality of predetermined positions to transmit power to the respective plurality of developing devices that correspond to the plurality of predetermined positions and a clutch device to selectively rotate the disc to the plurality of predetermined positions.

The clutch device may include a spring clutch having a first determining part to position the disc at a first position, a second determining part to position the disc at a second position, and a third position determining part to position the disc at a third position.

The clutch device may also include a restriction device having a locking member which contacts each of the first, second, and third position determining parts of the spring clutch to locate the disc at the first, second, and third positions respectively.

The image forming apparatus may also include a first coupling gear to rotate in a first direction via the disc to interrupt power transmitted to one of the plurality of developing devices and to rotate in a second direction to transmit power to the one of the plurality of developing devices, and a second coupling gear to rotate in a first direction via the disc to interrupt power transmitted to the remaining other plurality of developing devices and to rotate in a second direction to transmit power to the remaining other plurality of developing devices.

BRIEF DESCRIPTION OF THE DRAWINGS

These and/or other aspects and utilities of the embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
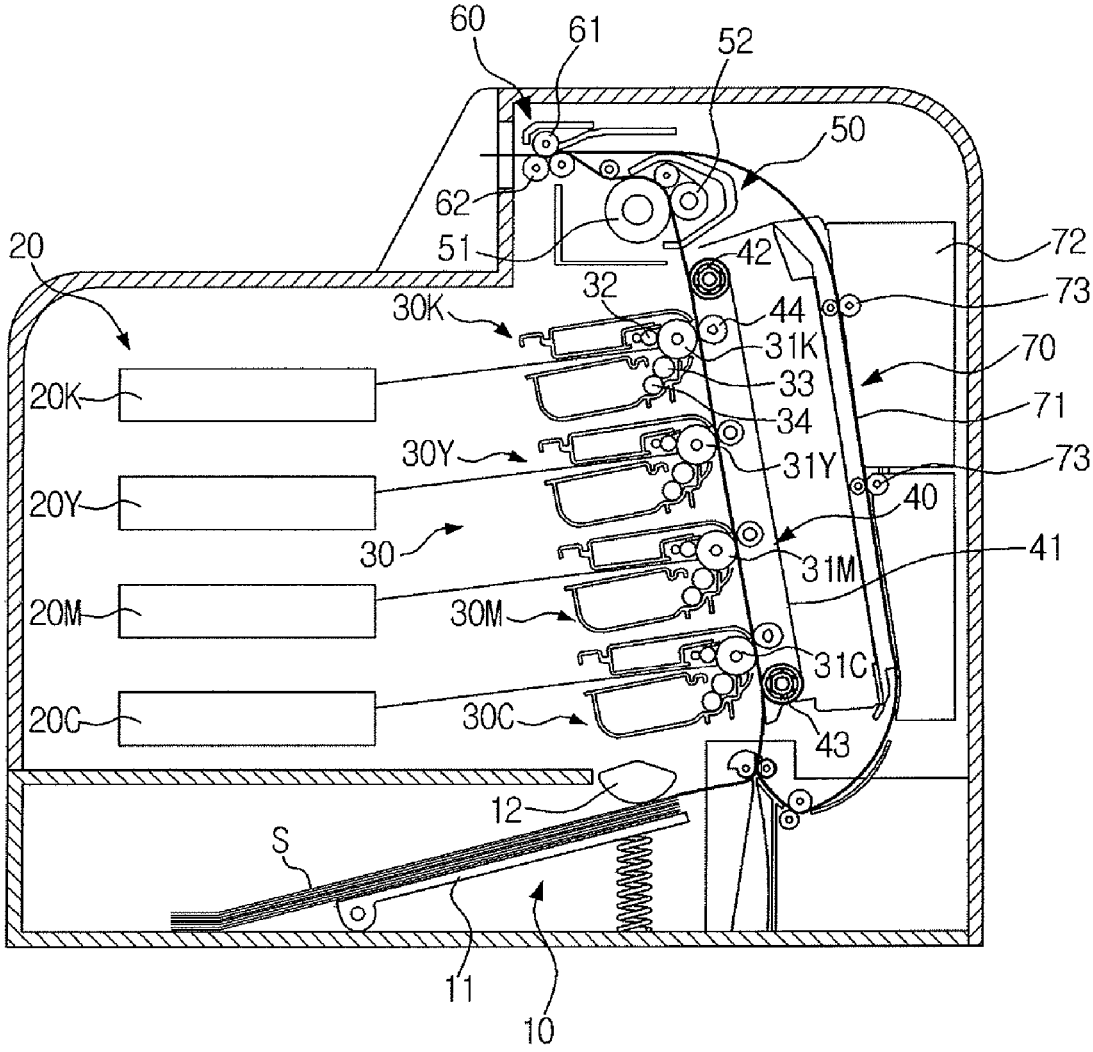
FIG. 1 is a sectional view illustrating an image forming apparatus in accordance with an embodiment of the present general inventive concept.

Reference will now be made in detail to embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a sectional view illustrating an embodiment of the image forming apparatus in accordance with the present general inventive concept.

As illustrated in FIG. 1, the image forming apparatus according to the present general inventive concept includes a paper supply unit 10, an exposure unit 20, a development unit 30, a transfer unit 40, a fixing unit 50, a paper discharge unit 60, and a duplex print unit 70.

The paper supply unit 10 supplies a printing medium, e.g., paper S, to the image forming apparatus. The paper supply unit 10 includes a paper tray 11 on which the paper S is loaded, and a pickup roller 12 which picks up the paper S loaded on the paper tray 11 sheet by sheet. The paper selected by the pickup roller 12 is fed to the development unit 30.

The development unit 30 includes four developing devices 30K, 30Y, 30M and 30C, in which toners of different colors, e.g., black (K), yellow (Y), magenta (M), and cyan (C) are contained. The developing devices 30K, 30Y, 30M and 30C are provided with photosensitive bodies 31K, 31Y, 31M and 31C, respectively on which electrostatic latent images are formed by the exposure units 20K, 20Y, 20M, and 20C. The exposure units 20K, 20Y, 20M, and 20C irradiate light that corresponds to image information of black, yellow, magenta, and cyan to the photosensitive bodies 31K, 31Y, 31M and 31C of the corresponding developing devices according to a print signal.

Each of the developing devices 30K, 30Y, 30M and 30C include a charge roller 32 to charge each of the photosensitive bodies 31K, 31Y, 31M and 31C, a developing roller 33 to develop the electrostatic latent image formed on each of the photosensitive bodies 31K, 31Y, 31M and 31C into a toner image, and a supply roller 34 to adhere the toner image to the developing roller 33.

The transfer unit 40 transfers the toner image developed on the photosensitive bodies to the paper S. The transfer unit 40 includes a transfer belt 41 to rotate while contacting the photosensitive bodies 31K, 31Y, 31M and 31C, a driving roller 42 to drive the transfer belt 41, a tension roller 43 to maintain a constant tensile force of the transfer belt 41, and four transfer rollers 44 to transfer the toner image developed on the photosensitive bodies 31K, 31Y, 31M and 31C onto the paper.

The fixing unit 50 fixes the transferred toner image onto the paper S by applying heat and pressure to the paper S. The fixing unit 50 includes a heat roller 51 which has a heat source to heat the toner-transferred paper S, and a press roller 52 disposed opposite to the heat roller 51 to maintain a constant fixing pressure with the heat roller 51.

The paper discharge unit 60 discharges the printed paper S to the outside of the image forming apparatus. The paper discharge unit 60 includes a discharge roller 61 to rotate by receiving power from a power source disposed within the image forming apparatus, and a discharge backup roller 62 disposed opposite to the discharge roller 61.

The duplex print unit 70 feeds the paper S having an image printed on one surface in an upward direction toward the development unit 30 to have an image subsequently printed on the other surface of the paper S. The duplex print unit 70 includes a guide frame 72 which forms a duplex-print path 71, and duplex-print feed rollers 73 mounted on the duplex-print path 71 to feed the paper.

Figure 2:
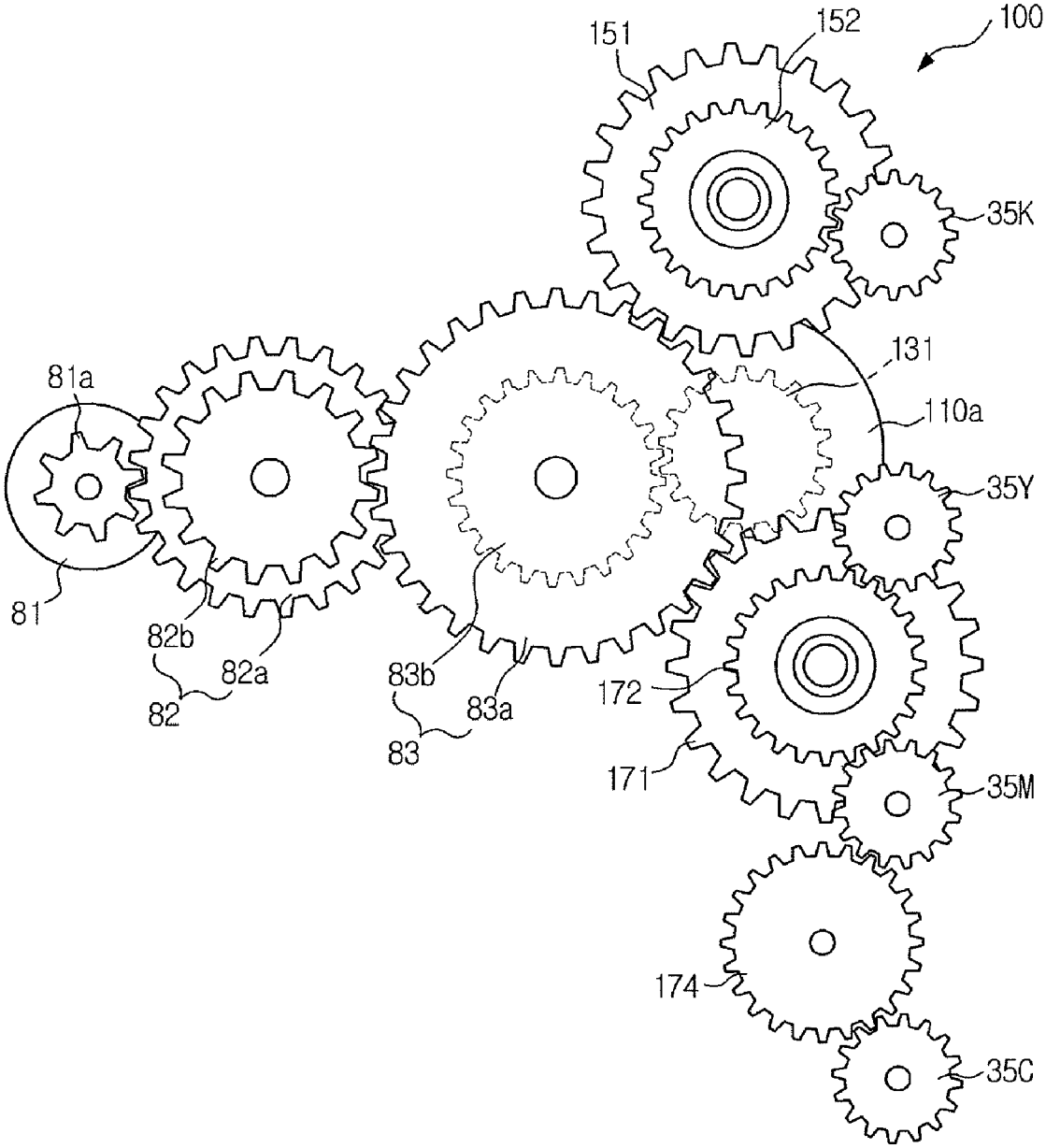
FIG. 2 is a view illustrating schematically a driving system which drives developing devices in the image forming apparatus in accordance with an embodiment of the present general inventive concept.
Figure 3:
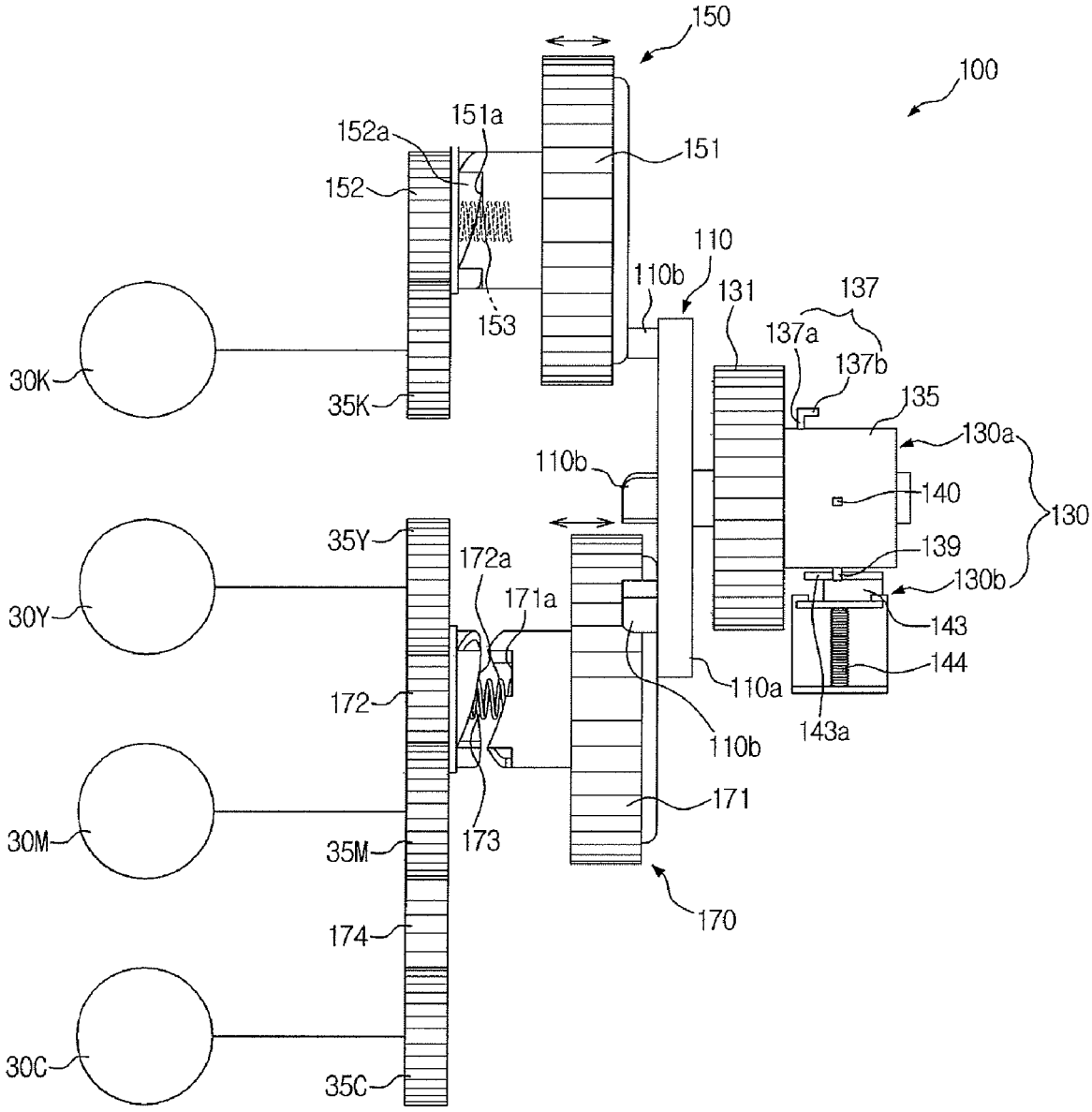
FIG. 3 is a side view of the driving system of the embodiment illustrated in FIG. 2.
Figure 4:
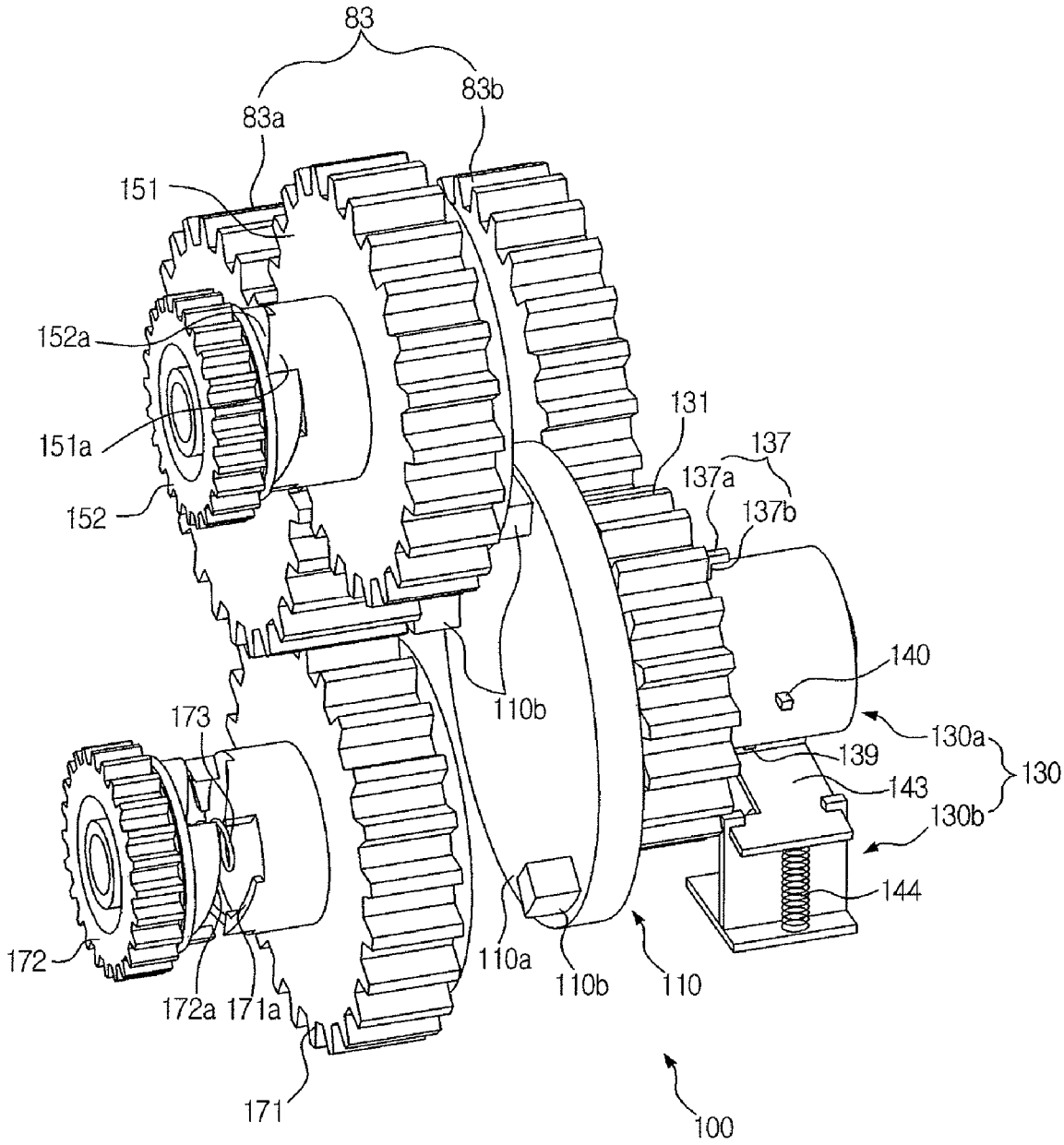
FIG. 4 is a perspective view illustrating the second power transmission gear and a power transmission device in the embodiment of FIG. 2 in accordance with the present general inventive concept.

FIG. 2 is a view illustrating an embodiment of a driving system to drive the developing devices in the image forming apparatus of FIG. 1. FIG. 3 is a side view illustrating the driving system of the embodiment of FIG. 2 excluding a driving source, a first power transmission gear and a second power transmission gear. FIG. 4 is a perspective view illustrating the second power transmission gear and the power transmission device in the embodiment of FIGS. 2 and 3. FIG. 2 illustrates the connecting relationship between the components in the driving system, but the actual sizes and positional relationship between the components may be different from those being illustrated.

As illustrated in FIGS. 2 to 4, the image forming apparatus of the present embodiment provides a driving system to drive the four developing devices 30K, 30Y, 30M, and 30C. The driving system includes a driving motor 81, which is a driving source, a power transmission device 100, which intermittently transmits power from the driving motor 81 to the developing devices 30K, 30Y, 30M, and 30C, and a first power transmission gear 82 and a second power transmission gear 83, which both transmit the power from the driving motor 81 to the power transmission device 100.

The first power transmission gear 82 has a large gear part 82*a* and a small gear part 82*b* which coaxially mount together, and the second power transmission gear 83 has a first gear part 83*a* and a second gear part 83*b* which also coaxially mount together. A pinion 81*a* is coupled to a rotating shaft of the driving motor 81. The pinion 81*a* engages with the large gear part 82*a* of the first power transmission gear 82. The small gear part 82*b* of the first power transmission gear 82 engages with the first gear part 83*a* of the second power transmission gear 83. The first gear part 83*a* of the second power transmission gear 83 engages with a first coupling gear 151 and a second coupling gear 171 of the power transmission device 100, and the second gear part 83*b* of the second power transmission gear 83 engages with a clutch gear 131 of the power transmission device 100. Therefore, if the driving motor 81 rotates the pinion 81*a*, power is transmitted through the first power transmission gear 82 and the second power transmission gear 83 to rotate the first coupling gear 151, the second coupling gear 171, and the clutch gear 131.

The power transmission device 100 includes a cam part 110 which rotates by receiving the power from the driving motor 81, a clutch device 130 which intermittently transmits power to the cam part 110 to control a stop position of the cam part 110, a first power transmission unit 150 which interacts with the cam part 110 and transmits power to one developing device 30K of four developing devices according to the stop position of the cam part 110, and a second power transmission unit 170 which interacts with the cam part 110 and transmits power to the other developing devices 30Y, 30M and 30C according to the stop position of the cam part 110.

The first power transmission unit 150 includes a first coupling gear 151 which is mounted slidably in an axial direction, a first driving gear 152 which couples to or separates from the first coupling gear 151 in an axial direction according to the sliding motion of the first coupling gear 151 as the first coupling gear 151 moves toward/away from the first driving gear 152, and an elastic member 153 which elastically biases the first coupling gear 151 in the direction separating the first coupling gear 151 from the first driving gear 152. The first driving gear 152 engages with a driven gear 35K provided in the black developing device 30K, and the driven gear 35K is connected to various components including the developing roller 33, which is mounted in the black developing device 30K.

Similarly, the second power transmission unit 170 includes the second coupling gear 171 which is slidably mounted in the axial direction, a second driving gear 172 which is mounted opposite to the second coupling gear 171, and an elastic member 173 which is interposed between the second coupling gear 171 and the second driving gear 172. The second driving gear 172 engages with a driven gear 35Y provided in the yellow developing device 30Y and a driven gear 35M provided in the magenta developing device 30M. The driven gear 35M is connected to a driven gear 35C, which is provided in the cyan developing device 30C through a connecting gear 174.

The first coupling gear 151 and the first driving gear 152 are provided with a pair of first coupling parts 151*a* and 152*a* which have complementary shapes. If the first coupling gear 151 rotates via the cam part 110 in a first direction and causes the pair of first coupling parts 151*a* and 152*a* to engage with each other, the power of the driving motor 81 is then transmitted to the black developing device 30K. However, if the first coupling gear 151 rotates in a second direction and causes the pair of first coupling parts 151*a* and 152*a* to disengage from each other, the rotational force of the first coupling gear 151 is not transmitted to the first driving gear 152. Similarly, the second coupling gear 171 and the second driving gear 172 are provided with a pair of second coupling parts 171*a* and 172*a*, respectively, which have complementary shapes. If the second coupling gear 171 rotates in the first direction via the cam part 110 and engages the pair of second coupling parts 171*a* and 172*a* with each other, the power of the driving motor 81 is transmitted to the yellow developing device 30Y, the magenta developing device 30M and the cyan developing device 30C. However, if the second coupling gear 171 rotates in a second direction and causes the pair of second coupling parts 171*a* and 172*a* to disengage from each other, the rotational force of the second coupling gear 171 is not transmitted to the second driving gear 172.

Figure 5:
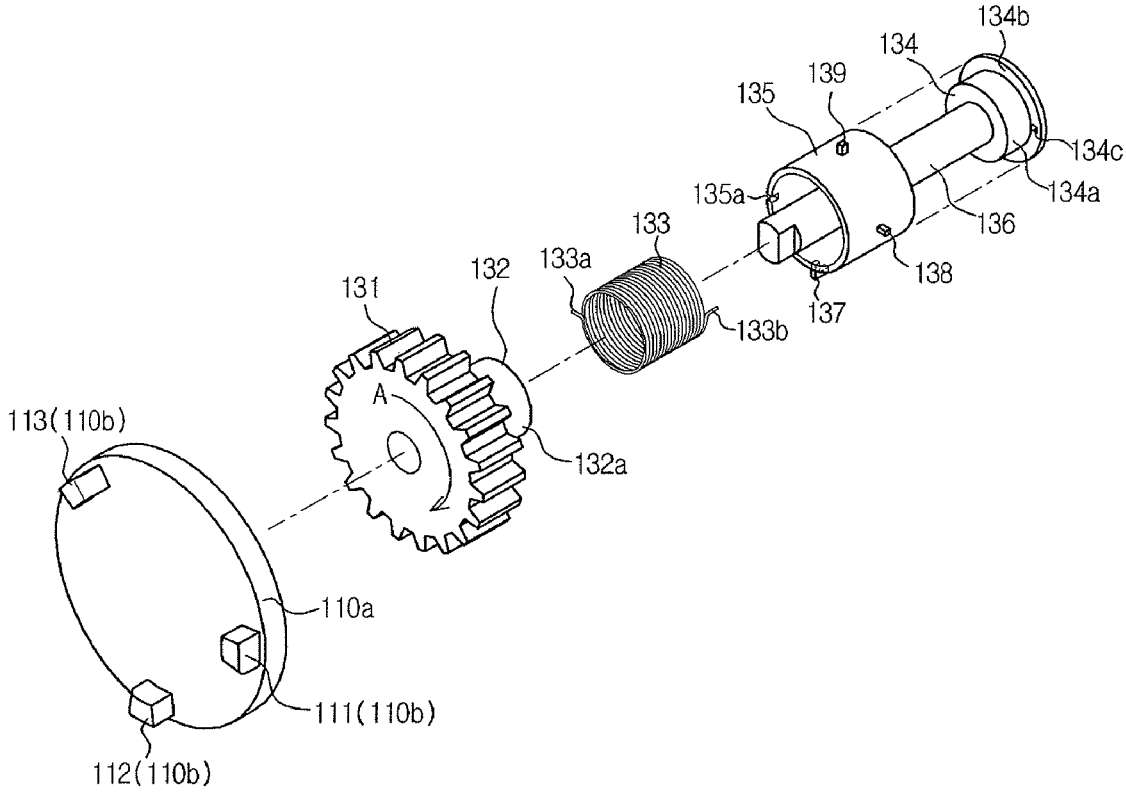
FIG. 5 is a perspective view illustrating a spring clutch and a cam part in the embodiment of FIG. 2 in accordance with the present general inventive concept.

FIG. 5 is a perspective view illustrating a spring clutch and the cam part in the image forming apparatus of the embodiment of FIG. 1. FIGS. 6 to 9 are views illustrating the operation of the power transmission device of FIGS. 2 to 4.

As illustrated in FIGS. 3 to 5, the cam part 110 includes a rotating disc 110*a* which rotates by receiving power from the driving motor 81, and a plurality of press members 110*b* which are provided on a surface of the rotating disc 110*a*. The rotating disc 110*a* is disposed adjacent to surfaces of the coupling gears 151 and 171 opposite to the surfaces on which the coupling parts 151*a* and 171*a* are formed.

Depending upon a stop position of the rotating disc 110*a*, the press members 110*b* either solely contact and press the first coupling gear 151 to move the first coupling gear 151 move in a first axial direction, or press and contact both of the coupling gears 151 and 171 to move the coupling gears 151 and 171 in the first axial direction, or separate from the coupling gears 151 and 171 to release the pressing force applied to the coupling gears 151 and 171 by the press members 110*b*. In other words, when the rotating disc 110*a* stops at a predetermined position the press members 110*b* press only the first coupling gear 151 to transmit power to only the black developing device 30K. When the rotating disc 110*a* stops at another predetermined position, the press members 110*b* press both the first coupling gear 151 and the second coupling gear 171 to transmit power to all the developing devices 30K, 30Y, 30M and 30C. Further, when the rotating disc 110*a* stops at yet another predetermined position, the press members 110*b* are separated from the first coupling gear 151 and the second coupling gear 171 to interrupt the power transmission to all the developing devices 30K, 30Y, 30M and 30C.

Figure 6:
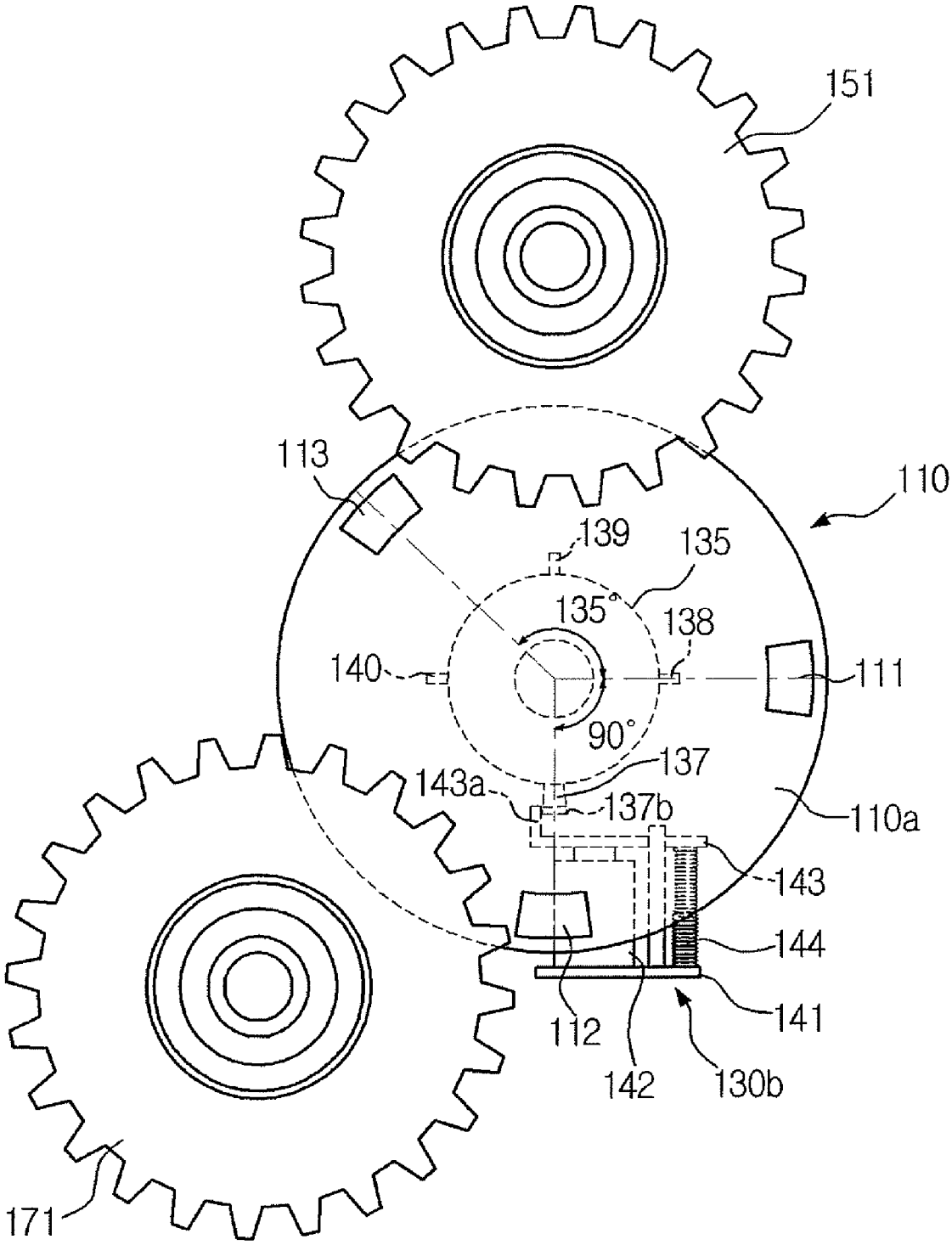
FIGS. 6 to 9 are views illustrating the operation of the power transmission device of the embodiment of FIG. 1 in accordance with the present general inventive concept.

Referring to FIG. 6, the above press members 110*b* may be configured as three press protrusions 111, 112 and 113, which protrude toward the coupling gears 151 and 171 and are arranged in a direction along the circumference of the rotating disc 110*a*. The arrangement of the press protrusions 111, 112 and 113 may be varied according to the size of the rotating disc 110*a* or the positional relationship between the rotating disc 110*a* and the coupling gears 151 and 171. As illustrated in FIG. 6, the first press protrusion 111 and the second press protrusion 112 are spaced apart from each other by about 90 degrees in a clockwise direction along the circumference of the rotating disc 110*a*, and the first press protrusion 111 and the third press protrusion 113 are spaced apart by about 135 degrees also in the clockwise direction along the circumference of the rotating disc 110*a*.

The clutch device 130, which determines the stop position of the cam part 110, includes a spring clutch 130*a* and a restriction unit 130*b* to restrict the spring clutch 130*a*.

As illustrated in FIG. 5, the spring clutch 130*a* includes a first hub 132 which is integrally formed at a clutch gear 131, a second hub 134 which intermittently connects to the first hub 132 by a clutch spring 133, and a cylinder-shaped clutch hub 135 which is provided between the first hub 132 and the second hub 134 to surround the clutch spring 133. One end of the clutch shaft 136 is coupled to the second hub 134. The rotating disc 110*a* of the cam part 110 is coupled to the other end of the clutch shaft 136. Accordingly, if the second hub 134 rotates, the clutch shaft 136 rotates to transmit power to the rotating disc 110*a*.

A cylinder portion 132*a* of the first hub 132 is inserted into one end portion of the clutch spring 133, and a cylinder portion 134*a* of the second hub 134 is inserted into the other end portion of the clutch spring 133. A first end 133*a* of the clutch spring 133 is inserted through a spring fixing slit 135*a* formed at a first end of the clutch hub 135, and a second end 133*b* of the clutch spring 133 is disposed within a spring fixing hole 134*c* that is formed on a flange portion 134*b* of the second hub 134.

As illustrated in FIGS. 3 to 9, a plurality of position determining parts 137, 138, 139 and 140 are provided on the outer peripheral surface of the clutch hub 135 along the circumference thereof to determine the stop position of the cam part 110.

As illustrated in FIG. 6, when the first position determining part 137 is restricted by the restriction unit 130*b*, the cam part 110 is in an idle state at a home position (i.e., a first position). At this time, the first coupling gear 151 and the second coupling gear 171 are separated from the press protrusions 111, 112 and 113. The first position determining part 137 has a first portion 137*a* which protrudes from the outer peripheral surface of the clutch hub 135, and a second portion 137*b* which extends from an end of the first portion 137*a* in the longitudinal direction of the clutch hub 135. When the restriction unit 130*b* is turned ON, or activated via a driving force, the second portion 137*b* of the first determining part 137 interferes with a locking member 143, which will be described in further detail below, and when the restriction unit 130*b* is turned OFF or deactivated, the second portion 137*b* of the first determining part 137 passes by the locking member 143 and does not interfere therewith. That is, the first determining part 137 does not abut the locking member 143. Since the detailed explanation of the constitution capable of performing the above operation is disclosed in Korean Patent Registration No. 619075, an additional explanation thereof will be omitted.

The second 138, third 139, and fourth 140 position determining parts are formed below the second portion 137*b* of the first position determining part 137, so as to interfere with the restriction unit 130*b* which is in the OFF state. In other words, the second 138, third 139, and fourth 140 position determining parts abut the restriction unit 130*b*. The second to fourth position determining parts, 138, 139 and 140 are each spaced apart from the first position determining part 137 by a 90 degree angle, an 180 degree angle, and a 270 degree angle, respectively. However, the aforesaid arrangement is merely one example of the representative spacing between the determining parts 138, 139, and 140 and the number and positional relationship of the position determining parts may be varied according to the design of the press protrusions.

Figure 7:
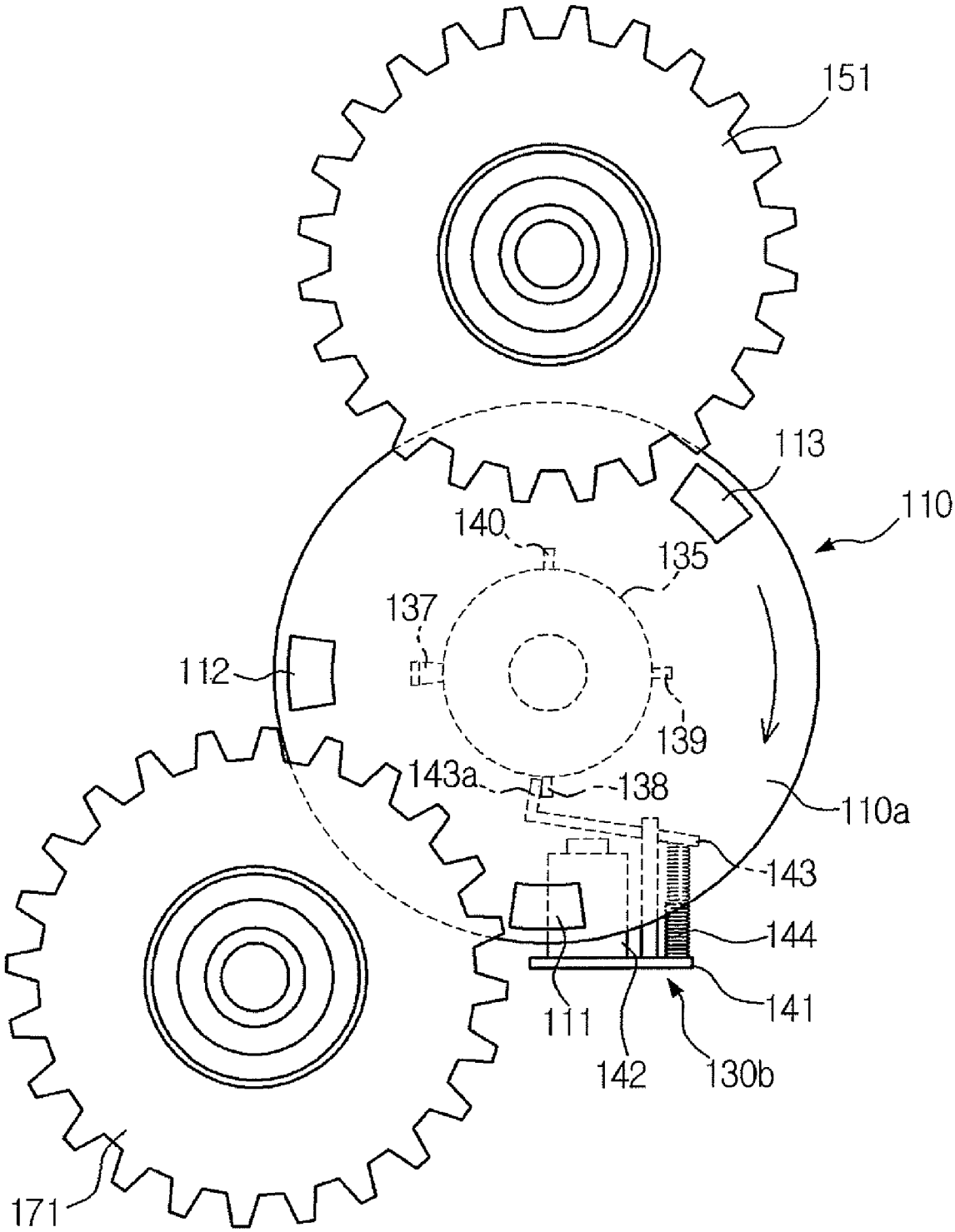
Figure 8:
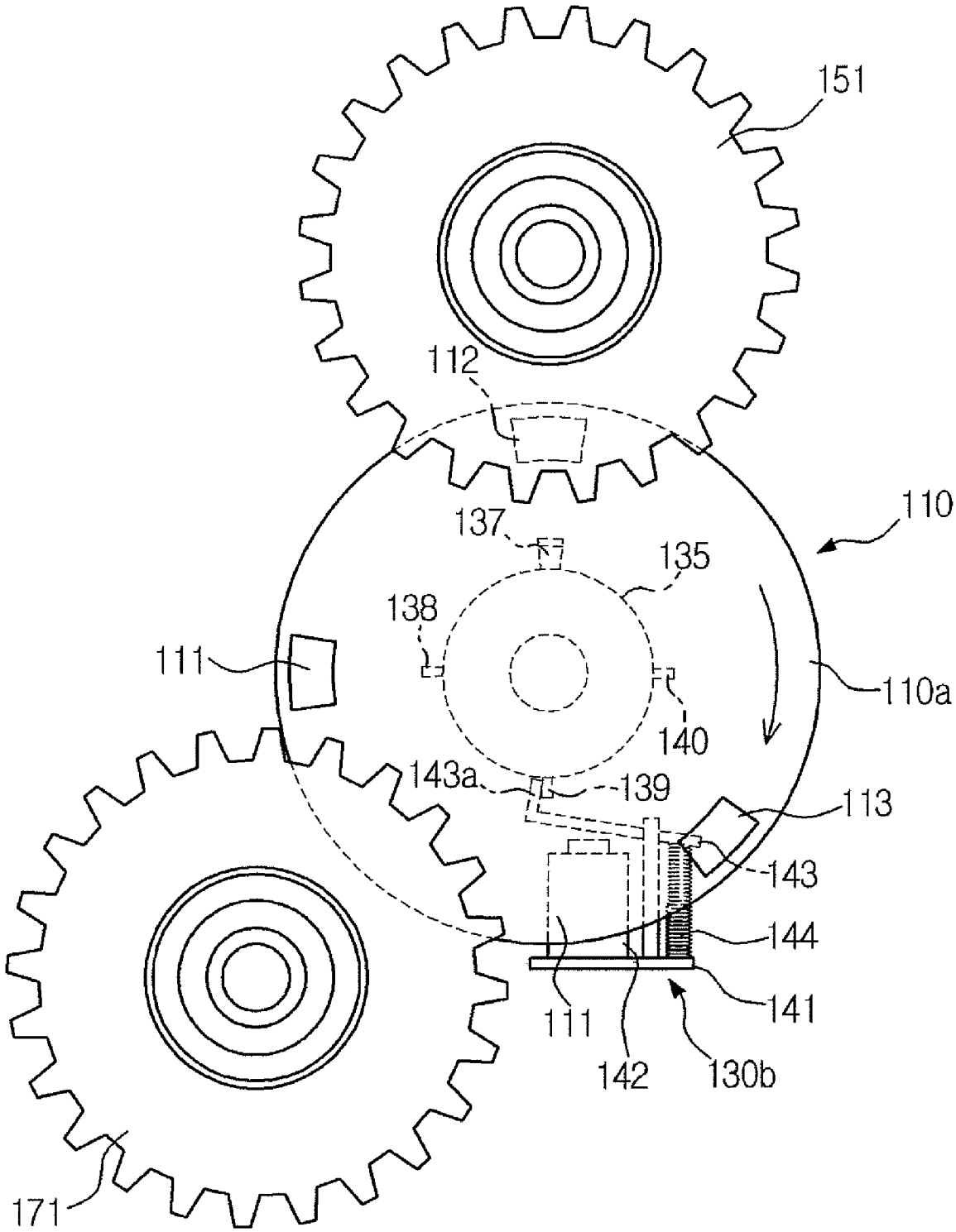
Figure 9:
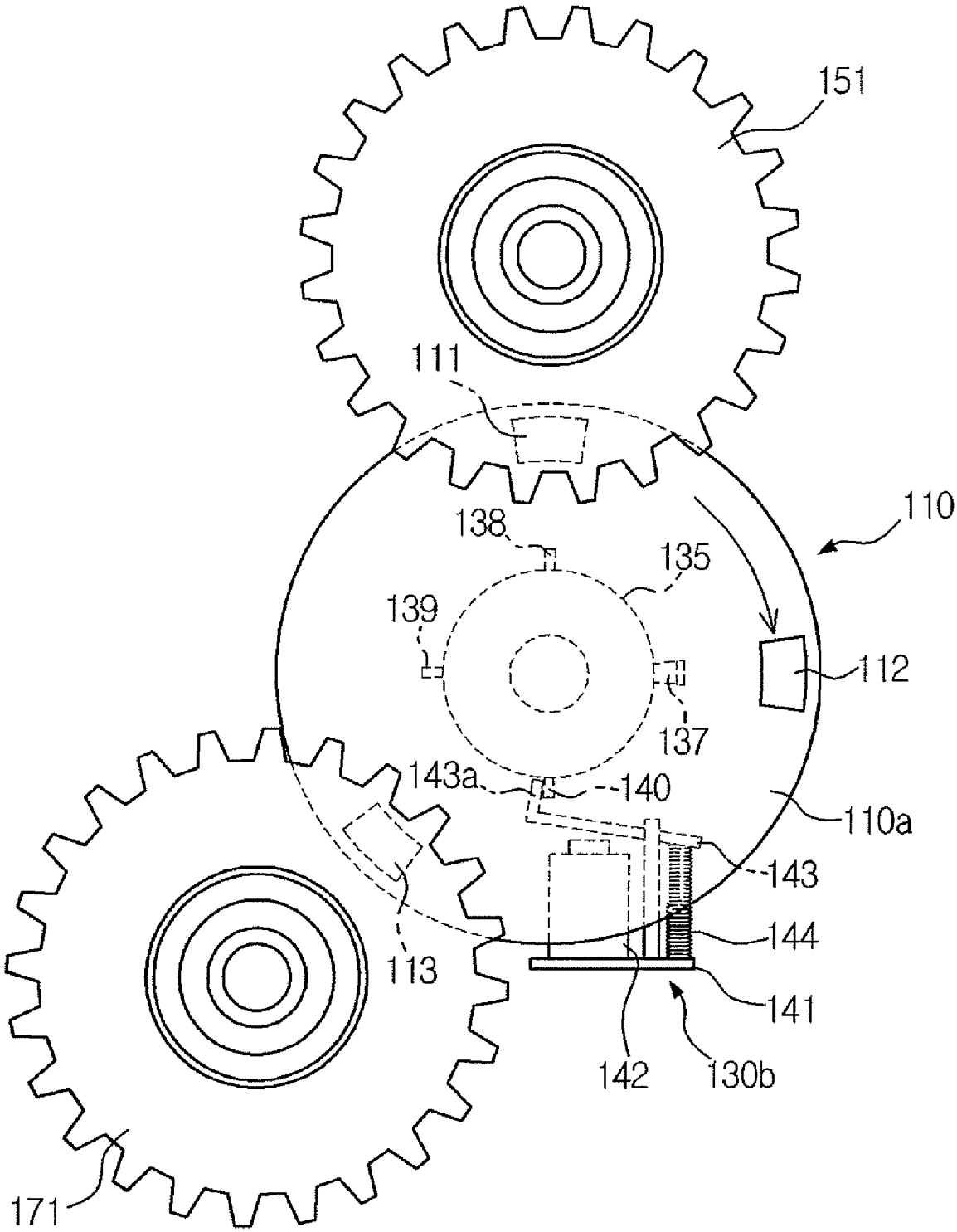

As illustrated in FIG. 7, if the restriction unit 130*b* restricts the second position determining part 138, the cam part 110 will stop at a second position. As illustrated in FIG. 8, if restriction unit 130*b* restricts the third position determining part 139, the cam part 110 will stop at a third position. As illustrated in FIG. 9, if the restriction unit 130*b* restricts the fourth position determining part 140, the cam part 110 will stop at a fourth position. When the cam part 110 is located at the second position, the press protrusions 111, 112 and 113 do not press or contact the first coupling gear 151 and the second coupling gear 171. When the cam part 110 is located at the third position, only one of the press protrusions out of the three press protrusions 111, 112 and 113 press the first coupling gear 151. When the cam part 110 is located at the fourth position, two out of the three press protrusions 111, 112 and 113 press the first coupling gear 151 and the second coupling gear 171, respectively. A detailed explanation of the above operation will be discussed in further detail below.

As illustrated in FIG. 5, if the clutch gear 131 rotates in an A direction by receiving a rotational force from the driving motor 81, the first hub 132 also rotates together with the clutch gear 131 in the A direction. During this scenario, the restriction unit 130*b* does not restrict the position determining parts 137, 138, 139 and 140. Further, as the first hub 132 rotates, the clutch spring 133, which is in frictional contact with the inner diameter of first hub 132, is twisted such that the inner diameter of the first hub 132 decreases and consequently tightens the cylinder portions 132*a* and 134*a* of the first and second hubs 132 and 134. The rotational force of the first hub 132 is transmitted to the second hub 134 through the clutch spring 133, and accordingly, the second hub 134 rotates together with the first hub 132. Thus, the rotational force from the driving motor 81 is transmitted from the gear clutch 131 to the cam part 110. But, when the restriction unit 130*b* interferes with the position determining parts 137, 138, 139 and 140 and restricts the movement of the clutch hub 135, although the first hub 132 rotates in the A direction, the clutch spring 133 cannot tighten the first hub 132 and the second hub 134. Accordingly, the first hub 132 idles, and thus power is not transmitted to the second hub 134. As a result, the cam part 110 stops at the position corresponding to the position determining part which is restricted by the restriction unit 130*b*. That is, if the cam part 110 stops at the second position, the second position determining part 138 is restricted by the restriction unit 130*b*.

The restriction unit 130*b* includes a bracket 141, a solenoid 142 which is supported by the bracket 141, and the locking member 143 which moves reciprocatingly between a first locking position in which the locking member interferes with the first position determining part 137 and a second locking position in which the locking member interferes with the second to fourth position determining parts 138, 139 and 140. The locking member 143 is hingedly coupled to the bracket 141. A latching protrusion 143*a* is formed at a first end of the locking member 143 and extends in a direction toward the clutch hub 135.

A spring 144 is connected to the other end of the locking member 143 to elastically bias a second end of the locking member 143 so that the latching protrusion 143*a* of the locking member 143 moves to the second locking position.

Hereinafter, an operation of the image forming apparatus according to an embodiment of the present general inventive concept will be described with reference to FIGS. 2 and 6 to 9.

First, an operation of the image forming apparatus in an idle mode in which the cam part 110 is in the home position will be described with reference to FIG. 6. If the image forming apparatus is powered on, the rotational force of the driving motor 81 is transmitted through the first power transmission gear 82 and the second power transmission gear 83 to rotate the clutch gear 131, the first coupling gear 151 and the second coupling gear 171. Electric current is applied to the solenoid 142 of the restriction unit 130*b*, and the locking member 143 is pulled toward the solenoid 142 by the magnetic force and accordingly moves to the first locking position (i.e., the position in which the locking member does not interfere with the second to fourth position determining parts 138, 139 and 140 but interferes with only the first position determining part 137). Thus, the rotating disc 110*a* rotates until the first position determining part 137 is latched by the latching protrusion 143*a*. When the first position determining part 137 is latched by the latching protrusion 143*a*, the rotating disc 110*a* stops at the home position (i.e., the first position). At this time, the press protrusions 111, 112 and 113 do not press the coupling gears 151 and 171, and accordingly power is not transmitted to the developing devices 30K, 30Y, 30M and 30C.

Next, an operation of the image forming apparatus in a ready mode will be described with reference to FIG. 7. When the above-described operation wherein the cam part 110 is in the home position is completed, the electric current applied to the solenoid 142 is interrupted (i.e., turned OFF). If the solenoid 142 is turned OFF and the magnetic force is removed, the locking member 143 moves to the second locking position by the elastic force of the spring 144, and releases the restriction of the first position determining part 137. Thus, the rotating disc 110*a* rotates until the second position determining part 138 is latched by the latching protrusion 143*a*. When the second position determining part 138 is latched by the latching protrusion 143*a*, the rotating disc 110*a* stops at the second position. At this time, the press protrusions 111, 112 and 113 do not press the coupling gears 151 and 171, and accordingly the power is not transmitted to the developing devices 30K, 30Y, 30M and 30C.

Next, the operation of the image forming apparatus in a black and white printing mode using only the black developing device 30K will be described with reference to FIG. 8. When the above-described ready mode is completed, if a black and white printing command is inputted, the solenoid 142 is kept in the ON state for a predetermined time T1, and then is turned OFF. Thus, the locking member 143 moves to the first locking position for the predetermined time T1, and then returns to the second locking position. At this time, the locking member 143 releases the restriction of the second position determining part 138, and the rotating disc 110*a* rotates until the third position determining part 139 is latched by the latching protrusion 143*a*. When the third position determining part 139 is latched by the latching protrusion 143*a*, the rotating disc 110*a* stops at the third position. At this time, the second press protrusion 112 is located at the position of pressing the first coupling gear 151, so that the first coupling gear 151 slides toward the first driving gear 152 and is connected to the first driving gear 152. Accordingly, the rotational force of the first coupling gear 151 is transmitted to the first driving gear 152, and the black developing device 30K is driven. As a result, the image forming apparatus performs the black and white printing operation using only the black developing device 30K. Because the printing operation through paper supply, exposure, development, transfer, fixing and paper discharge processes is well known in this art, the explanation thereof will be omitted.

Finally, the operation of the image forming apparatus in a color printing mode will be described with reference to FIG. 9. When the ready mode illustrated in FIG. 7 is completed, if the color printing command is input, the solenoid 142 is kept in the ON state for a predetermined time T2, and then is turned OFF. The predetermined time T2 is the time during which the third position determining part 139 passes by the locking member 143 without being latched thereby. The locking member 143 moves to the first locking position for the predetermined time T2, and then returns to the second locking position. At this time, the locking member 143 releases the restriction of the second position determining part 138, and the rotating disc 110*a* rotates until the fourth position determining part 140 is latched by the latching protrusion 143*a*. When the fourth position determining part 140 is latched by the latching protrusion 143*a*, the rotating disc 110*a* stops at the fourth position. At this time, the first press protrusion 111 is located at the position of pressing the first coupling gear 151, and the third press protrusion 113 is located at the position of pressing the second coupling gear 171, so that the first coupling gear 151 and the second coupling gear 171 respectively slide toward the first driving gear 152 and the second driving gear 172, and are connected to the first driving gear 152 and the second driving gear 172. Accordingly, the rotational force of the coupling gears 151 and 171 is transmitted to the driving gears 152 and 172, and thus all the developing devices 30K, 30Y, 30M and 30C, are driven to perform the color printing operation.

When the black and white printing operation or the color printing operation is completed, the image forming apparatus resumes the ready mode operation illustrated in FIG. 7 through the operation wherein the cam part 110 is in a home position.

The above description illustrates that the power transmission device intermittently transmits the power to the plurality of the developing devices, however this is not restricted thereto. The power transmission device can be adapted to intermittently transmit the power to the various driven bodies through an adequate change of design, as needed.

As is apparent from the above description, the image forming apparatus according to the present general inventive concept can achieve various operation modes via the power transmission device which is capable of intermittently transmitting power using one clutch device. Accordingly, the cost of components is reduced, and the image forming apparatus can be manufactured compactly without deteriorating the performance of the apparatus.

Further, when transmitting the power to the developing devices, it is not needed to continuously apply electric current to the power transmission device. Accordingly, even when the image forming apparatus is operated for a long time, deterioration of the performance or malfunction of the power transmission device is prevented, and power consumption is reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus including a driving source, a plurality of driven bodies which are driven by the driving source, and a power transmission device which is provided between the driving source and the plurality of driven bodies, the power transmission device including:

a cam part to rotate by receiving power from the driving source;

a clutch device to intermittently transmit power to the cam part to determine a stop position of the cam part;

a first power transmission unit to transmit the power to one of the plurality of driven bodies according to the stop position of the cam part; and a second power transmission unit to transmit the power to the other driven bodies of the plurality of driven bodies according to the stop position of the cam part, to drive the other driven bodies at the same time.

2. The image forming apparatus according to claim 1, wherein the cam part includes a rotating disc, and a plurality of press members provided on one surface of the rotating disc to press the first power transmission unit and the second power transmission unit according to the stop position of the rotating disc.

3. The image forming apparatus according to claim 2, wherein the plurality of press members press only the first power transmission unit or press both the first power transmission unit and the second power transmission unit according to the stop position of the cam part.

4. The image forming apparatus according to claim 2, wherein the plurality of press members are separated from the first power transmission unit and the second power transmission unit according to the stop position of the cam part, so that the first power transmission unit and the second power transmission unit are in an unpressed state.

5. The image forming apparatus according to claim 2, wherein the plurality of press members include three press protrusions which are arranged in a direction along a circumference of the rotating disc.

6. The image forming apparatus according to claim 5, wherein two of the three press protrusions are spaced apart by a 90 degree angle along the circumference of the rotating disc, and another two of the three press protrusions are spaced apart from each other by a 135 degree angle along the circumference of the rotating disc.

7. The image forming apparatus according to claim 1, wherein the clutch device includes a plurality of position determining parts to determine the stop position of the cam part, and a restriction unit which restricts the plurality of position determining parts in ON/OFF states.

8. The image forming apparatus according to claim 7, wherein the plurality of position determining parts include:

a first position determining part to interfere with the restriction unit when the restriction unit is in the ON state to determine a home position of the cam part; and a second position determining part, a third position determining part and a fourth position determining part to interfere with the restriction unit when the restriction unit is in the OFF state.

9. The image forming apparatus according to claim 8, wherein when the restriction unit restricts the first position determining part or the second position determining part, the cam part is separated from the first power transmission unit and the second power transmission unit to interrupt power transmission to the plurality of driven bodies.

10. The image forming apparatus according to claim 8, wherein when the restriction unit restricts the third position determining part, the cam part interferes with the first power transmission unit to transmit the power through the first power transmission unit.

11. The image forming apparatus according to claim 8, wherein when the restriction unit restricts the fourth position determining part, the cam part interferes with both the first power transmission unit and the second power transmission unit to transmit the power through the first power transmission unit and the second power transmission unit.

12. The image forming apparatus according to claim 1, wherein each of the first power transmission unit and the second power transmission unit include a driving gear, a coupling gear to slidably interact with the cam part and to rotate by receiving power from the driving source, and an elastic member which elastically biases the coupling gear to a direction of separating the coupling gear from the driving gear.

13. The image forming apparatus according to claim 1, wherein the plurality of driven bodies include four developing devices having respective toner colors including yellow, magenta, cyan, and black, and wherein the first power transmission unit transmits power to the developing device having the black toner color.

14. An image forming apparatus that transmits power from a driving source to a plurality of developing devices with respective colors, comprising:

a disc to selectively rotate to a plurality of predetermined positions to transmit power to the respective plurality of developing devices that correspond to the plurality of predetermined positions; and a clutch device to selectively rotate the disc to the plurality of predetermined positions, wherein the disc transmits power to the respective plurality of developing devices along a flat surface thereon.

15. The image forming apparatus of claim 14, wherein the clutch device includes a spring clutch comprising:

a first determining part to position the disc at a first position;

a second determining part to position the disc at a second position; and a third position determining part to position the disc at a third position.

16. The image forming apparatus of claim 15, wherein the clutch device further comprises:

a restriction device having a locking member which contacts each of the first, second, and third position determining parts of the spring clutch to position the disc at the first, second, and third positions respectively.

17. The image forming apparatus of claim 16, further comprising:

a first coupling gear to move in a first direction via the disc to interrupt power transmitted to one of the plurality of developing devices and to move in a second direction to transmit power to the one of the plurality of developing devices; and a second coupling gear to move in a first direction via the disc to interrupt power transmitted to the remaining other plurality of developing devices and to move in a second direction to transmit power to the remaining other plurality of developing devices.

* * * * *